United States Patent [19]

Evans

[11] 3,994,241

[45] Nov. 30, 1976

[54] REMOVABLE STACKING FRAME ASSEMBLY FOR PALLETS

[75] Inventor: George Q. Evans, Paramount, Calif.

[73] Assignee: Keyrack Company, Inc., Paramount, Calif.

[22] Filed: Oct. 6, 1975

[21] Appl. No.: 619,611

[52] U.S. Cl. ..... 108/53.5; 108/901

[51] Int. Cl.[2] ..... B65D 19/38

[58] Field of Search ..... 108/53 B, 56 R, 55 R, 108/DIG. 1, 53.5, 901

[56] References Cited

UNITED STATES PATENTS

| | | | |
|---|---|---|---|
| 3,095,837 | 7/1963 | Skubic | 108/53 B |
| 3,576,169 | 4/1971 | De Pew | 108/53 B |
| 3,677,200 | 7/1972 | Coccagna et al. | 108/53 B |
| 3,759,194 | 9/1973 | Fujii et al. | 108/DIG. 1 |
| R26,481 | 10/1968 | Evans | 108/53 B |

FOREIGN PATENTS OR APPLICATIONS

| | | | |
|---|---|---|---|
| 1,007,574 | 10/1965 | United Kingdom | 108/55 |

*Primary Examiner*—Roy D. Frazier
*Assistant Examiner*—Darrell Marquette
*Attorney, Agent, or Firm*—Huebner & Worrel

[57] ABSTRACT

A removable stacking frame assembly particularly suited for association with a plastic merchandise pallet. The stacking frame includes a plurality of upwardly extending legs each having foot members adapted to be detachably secured to a pallet. In addition, there is provided an upper frame member associated with the legs serving as a stacking frame wherein merchandise on the pallet is protected from damage and which may also serve to support another pallet mounted thereon.

9 Claims, 4 Drawing Figures

REMOVABLE STACKING FRAME ASSEMBLY FOR PALLETS

BACKGROUND OF THE INVENTION

Heretofore, stacking frames for merchandise pallets have been available. However, the prior art devices of which applicant is familiar are normally of the type that are primarily affixed to a pallet whereby the whole unit must be shipped together and not in knocked down form.

In the case of those stacking frames which are removable such as found in U.S. Pat. Re. No. 26,481, the particular construction of the stacking frame is only susceptible to use with what are considered to be conventional wood pallets. Such a conventional pallet has 2 × 4 parallel stringers with boards laid across the stringers and nailed thereto.

SUMMARY OF THE INVENTION

With the advent of plastic pallets which are primarily constructed with honeycombing bores therethrough to achieve a lightweight durable pallet, it has been found that the conventional types of removable stacking frame assemblies are not appropriate for use with such pallets.

The present invention is directed to a plurality of upwardly extending legs each of which are fitted with appropriate foot members containing guide and stop means adapted to interfit within a conventional plastic honeycomb pallet whereby when the legs and an upper frame member are united the frame member will serve to protect merchandise mounted on the pallet as well as to serve as a support to rest another pallet on top thereof for warehouse or other stacking.

In addition the removable stacking frame assembly of this invention can be used with any type of a pallet which is formed with appropriate openings and recesses in the corners thereof to receive the foot members of the upwardly extending legs.

Each of the upwardly extending legs includes a foot member which is adapted to engage the corner of a pallet. The upper stacking frame member may be of a conventional type such as a cross or square which has appropriate fittings thereon to mate with the upper end of the upwardly extending legs.

Another object is to provide a removable stacking frame assembly which is relatively easy to disassemble from a pallet whereby the stacking frame may be knocked down for shipping between the manufacturer and the user or between a point of use back to a manufacturer.

Another object is to provide a stacking frame assembly where the upwardly extending legs are laterally resilient so that they may be sprung and the foot members may be biased whereby they lock with the pallet affording rigidity to the leg members and in turn the entire stacking frame assembly would be properly retained.

These and other objects and advantages will become apparent from the following description and drawings, wherein:

DETAILED DESCRIPTION OF THE PREFERRED EMBODIMENTS

Figure 1:
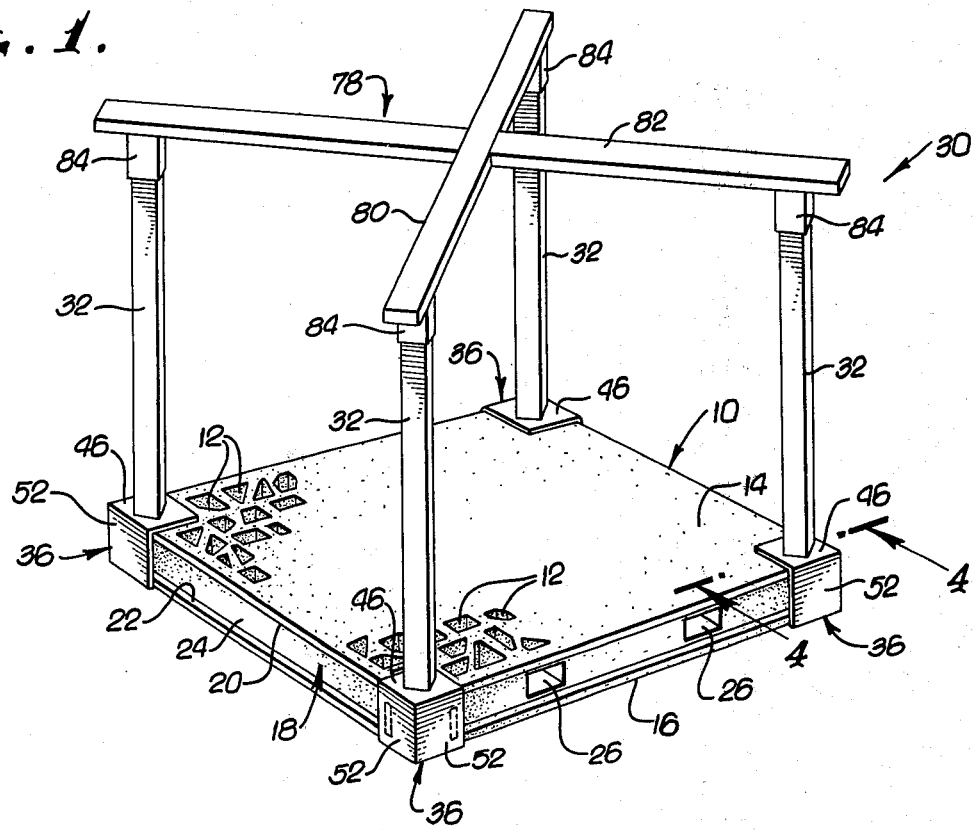
FIG. 1 is a perspective view of the removable stacking frame assembly in position upon a pallet.

Referring to the drawings, there is illustrated in FIG. 1 a pallet generally designated 10 which in the instance illustration is of a relatively new variety identified as a plastic honeycomb pallet. This pallet 10 is formed from a plastic material wherein it is a solid piece of material with various openings 12 extending from the top surface 14 through the bottom surface 16 of the pallet 10. These openings or honeycombing can be varied in size and shape as shown in the drawings. Between the respective openings 12 the material, of course, is solid and will extend from the top surface 14 to the bottom surface 16. Such construction heretofore identified as honeycombing adds rigidity and strength to the plastic material and yet will reduce the weight of the pallet from those which are identified as conventional pallets normally made from wood or heavy cardboard.

Figure 3:
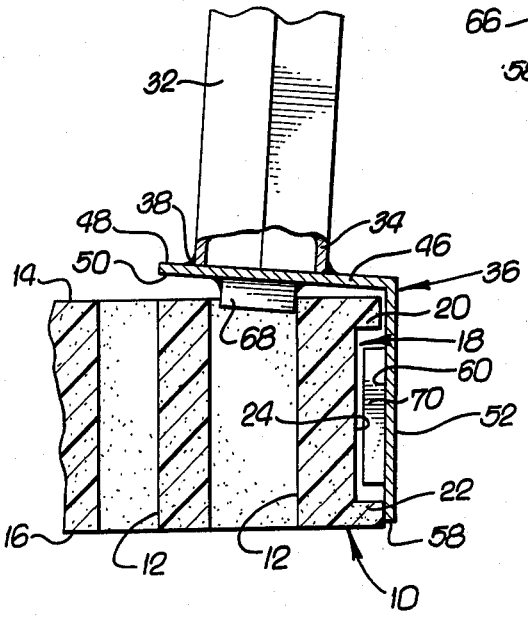
FIG. 3 is a side elevational cross sectional view of a portion of the pallet and foot member showing how the foot member is biased to lock it to the pallet.
Figure 4:
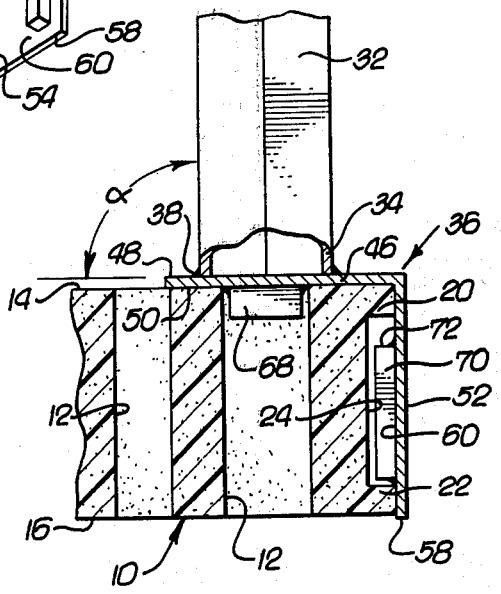
FIG. 4 is a cross sectional view of the foot member in locked position on a pallet taken on line 4—4 of FIG. 1.

In the case of the pallet 10 illustrated in the drawings there is illustrated an annular recess 18 extending along all four sides of the particular pallet illustrated. This recess 18, best seen in FIGS. 3 and 4, is defined by an upper extension 20 of the top surface 14, and a lower extension 22 of the bottom surface 16. Inwardly thereof and extending between the extensions 20 and 22 is a back wall 24. Thus the recess 18 is formed by the extensions 20, 22 and back wall 24.

In addition to the structure recited relative to the pallet 10, the pallet 10 includes at least a pair of fork pockets 26 which are spaced apart and parallel to each other extending from one side of the pallet through to the opposite side. These fork pockets are adapted to receive the forks of a fork lift truck to pick up the pallet and stacking frame assembly for transporting from one place to another.

When the particular plastic pallet 10 as illustrated is used with this invention it is preferable that the openings 12 adjacent each corner of the pallet be of a constant internal lateral dimension so as to receive a portion of the stacking frame assembly to be described.

The stacking frame assembly generally designated 30 includes a plurality of leg members 32 which may be made of tubular stock. In the particular embodiment illustrated, each of the leg members 32 are rectangular in shape. However, it should be noted that circular tubular stock can also be used without departing from the spirit of the invention. Each of the leg members 32 at their lower ends 34 are secured to foot members generally designated 36 by welding 38 or other means.

Figure 2:
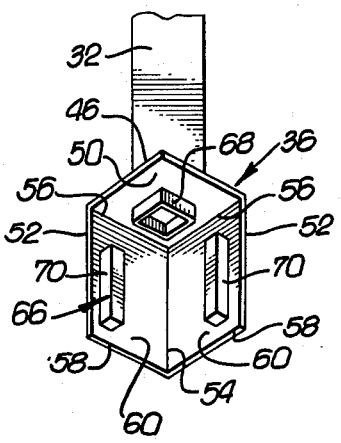
FIG. 2 is a perspective view of one of the foot members of an upwardly extending leg of the stacking frame assembly.

The foot members 36 best illustrated in FIG. 2, include a top plate 46 which is preferably rectangular. This plate has an upper surface 48 and a lower surface 50. The leg members 32 are each secured by the welding 38 or otherwise to the upper surface 48 of the top plate. In addition, there are a pair of preferably identical corner plates 52 which extend downwardly from the top plate 46 normal to each other. These plates 52 can either be bent downwardly from the top plate 46 making the entire foot member one piece wherein the joint 54 is welded or the corner plates 52 can be of one piece bent at the join 54 making them normal to each other and they are then welded at their tops 56 to the undersurface 50 of the top plate 46.

The preferred length of the corner plates 52 is such that the bottom edges 58 thereof are slightly below the pallet 10 as best seen in FIG. 4. With such construction damage to a pallet 10 is lessened because the weight is taken upon the edges 58. Additionally, each of the foot members 36 are provided with locking means generally designated 66 associated with the interior of the foot members.

In the preferred embodiment said locking means 66 include a cap stop or spacer member 68 which is welded or otherwise secured to the lower surface 50 of the top plate 46. The exterior dimension of the cap stop 68 is slightly less than the exterior dimension of the opening 12 adjacent each of the corners of the pallet 10. This can be seen in FIGS. 3 and 4. Additionally, in the preferred embodiment there are a pair of corner plate stop or spacer members 70 each of which are affixed to the respective inner surface 60 of the corner plates 52 by welding or other means. As can be seen in FIG. 2, these stops 70 are preferably of bar stock wherein the length of each of the stops 70 is slightly less than the distance between the upper extension 20 and lower extension 22 of the pallet 10. In addition, the thickness of each of the corner plate stops 70 would be slightly less than the width of the recess 18 formed by the upper and lower extension 22 and back wall 24.

In operation, the leg member 32 is positioned with the corner plates 52 adjacent to the corner of the pallet 10 wherein the leg member 32 and foot member 36 are moved inwardly to the corner. At the same time the leg 32 is biased slightly outwardly as best seen in FIG. 3 whereby the cap stop 68 may be elevated above the top surface 14 of the pallet 10 so that it will clear the surface and seat itself within the opening 12. At this point the leg 32 is moved downwardly and the corner plate stops 70 which are already within the recess 18 also move downwardly within the recess so that the final assembly is accomplished as can be seen in FIG. 4. With the final positioning of the foot member 36 in the position as shown in FIG. 4, the cap stop 68 is within the opening 12 and each of the corner plate stops 70 are within the recesses 18 on two sides of the pallet stops outwardly of the corner thereof.

As can be seen in the mounting in FIG. 4, the cap stop 68 within the opening 12 will prevent lateral movement of the foot member 36 and in turn the leg 32. In addition the corner stop or spacer members 70 will prevent upward movement of the leg 32 and foot member 36 because the top 72 of the corner plate stop 70 will engage the upper extension 20.

When it is desired to disassemble the stacking rack 30, the legs 32 can be lifted upwardly where the top 72 of stops 70 engage the upper extension 20, and then biased outwardly as seen in FIG. 3 so that the cap stop 68 of the locking means 66 will become completely disengaged from the opening 12 and the leg and foot member 36 lifted off.

In the preferred embodiment illustrated in the drawings after each of the leg members 32 are positioned upon the pallet an upper frame member generally designated 78 is mounted on the upper ends of the legs 32. In the embodiment illustrated the upper frame member includes a pair of cross members 80 and 82. The underneath of which at each end of said members are fitted with a slip socket connection 84. The interior of the slip socket connection 84 is formed with a dimension approximately the exterior dimension of the legs 32 so that each of the legs 32 may fit within the slip socket connection 84. However, the slip socket connection 84 may also be of an external dimension which is slightly less than the interior dimension of the tubular leg 32 and slip into the leg for connection without departing from the spirit of the invention.

As an additional feature to the stacking frame assembly 30 each of the legs 32 are preferably bent inwardly from the vertical when welded or otherwise secured to the leg member 36. It has been found that an angle of approximately 2° off vertical as best seen in FIG. 4 is sufficient for the purpose. The reason for the offset of each of the legs 32 inwardly toward each other is to assure a slight outward biasing of the leg when inserted within the slip socket connections 84. This will assure a maintenance of the upper frame member 78 to the legs during transportation of the pallet and stacking frame assembly.

While the locking means 66 preferably includes three members, namely the cap stop 68 and corner plate stops 70 it should be realized that in order to achieve the desired results it is only necessary that there be a sufficient number of stops to prevent both lateral and vertical movement of the leg and foot member 36. Therefore, it may be possible to utilize only one corner plate stop 70 with the cap plug 68. In addition, it may be desirable to assure proper locking with the corner plate stops 70 to be in effect one piece of metal or material which can be bent at right angles having one section extending along the inner surface 60 of one corner plate and along the other inner surface 60 of the other corner plate. Further, as can be appreciated, the shape of the cap stop 68 while illustrated as being rectangular in the drawings, can be any other exterior shape as long as its exterior dimension corresponds relatively closely to the dimension of the opening 12.

While the preferred embodiment of the upper frame member 78 illustrates a pair of cross members 80 and 82, it should be realized that any type of upper frame member such as a square shape member may be used to accomplish the intended result.

Throughout the application there has been specific reference and definition given to the plastic honeycomb pallet 10. It should be realized that the foot members of this stacking frame assembly can be utilized with any other type of pallet structure wherein there is adjacent the corners of the pallet a bore of some depth through the top surface and also that the sides of the pallet extending from the corner be sufficiently recessed to receive the corner plate locking member described above. In other words, this application is not necessarily restricted to the use with plastic pallets.

Although I have herein shown and described my invention in what I have conceived to be the most practical and preferred embodiment, it is recognized that departures may be made therefrom within the scope of my invention.

I claim:

1. A removable stacking frame assembly adapted for use with a merchandise pallet wherein the pallet includes an upper platform surface and vertical sides extending downwardly from said upper platform surface, said pallet having a plurality of corners each formed by the intersection of two of said vertical sides, and said upper platform surface formed with a vertical opening adjacent each of said corners extending downwardly and each of said vertical sides including a recess projecting laterally from said corner along said side, said frame assembly comprising:

leg members equal in number to the number of corners of said pallet each of which is longitudinally rigid and resilient laterally of their own plane;

a foot member secured to the bottom of each of said leg members, said foot members adapted to encase the corner of said upper platform surface and each of said foot members include a top plate adapted to rest on said upper platform of said pallet, a pair of corner plates depending from said top plate and normal to each other;

each of said foot members being fitted with locking means including interior projections one of which depends from said top plate and another of which extends inwardly from at least one of said corner plates;

said foot members adapted to be biased to seat said locking means in said opening and a portion of said recess of said pallet and when so seated to prevent lateral and vertical displacement of said foot member and in turn said leg member; and an upper frame member connectable with the end of said legs remote said pallet whereby said upper frame member is spaced from and generally parallel to said upper platform of said pallet and said stacking frame is complete.

2. A removable stacking frame assembly as defined in claim 1 wherein there are projections extending inwardly from both corner plates.

3. A removable stacking frame assembly as defined in claim 1 wherein said interior projection depending from said top plate has an exterior dimension slightly less than the dimension of said vertical opening adjacent each corner of said pallet so that when seated lateral disengagement of said foot and leg member is prevented.

4. A removable stacking frame assembly as defined in claim 1 wherein said projection extending inwardly from one of said corner plates has an exterior longitudinal dimension less than the vertical height of said recess so that when seated vertical disengagement of said foot and leg member is prevented.

5. A removable stacking frame assembly and merchandise pallet combinations wherein:

said pallet is of a single piece construction having an upper platform surface and lower platform surface which pallet is honeycombed with a plurality of holes extending from the upper platform surface through the lower platform surface and wherein the pallet is rectangular including four vertical sides extending between said upper and lower platform surface;

said pallet having four corners and said corners formed by the intersection of two of said vertical sides;

said vertical sides each including a recess formed therein said recesses extending laterally from each of said corners;

said upper platform surface adjacent each of said corners having vertical locking openings extending into said pallet;

a pair of parallel spaced apart fork pockets extending through said pallet from one vertical side wall to the opposite vertical side wall;

leg members equal in number to the number of corners of said pallet each of which is longitudinally rigid and resilient laterally of their own plate;

a foot member secured to the bottom of each of said leg members, said foot members adapted to encase the corner of said upper platform surface and each of said foot members include a top plate adapted to rest on said upper platform of said pallet, a pair of corner plates depending from said top plate and normal to each other and of a length greater than said sides;

each of said foot members being fitted with locking means including interior projections one of which depends from said top plate and another of which extends inwardly from at least one of said corner plates;

each of said foot members adapted to be biased to seat said locking means in said locking opening and a portion of said recess of said pallet and when so seated to prevent lateral and vertical displacement of said foot member and in turn said leg member; and an upper frame member connectable with the end of said legs remote said pallet whereby said upper frame member is spaced from and generally parallel to said upper platform of said pallet and said stacking frame is complete.

6. A removable stacking frame assembly and merchandise pallet as defined in claim 5 wherein there are projections extending inwardly from both corner plates.

7. A removable stacking frame assembly and merchandise pallet as defined in claim 5 wherein said interior projection depending from said top plate has an exterior dimension slightly less than the dimension of said vertical locking opening adjacent each corner of said pallet so that when seated lateral disengagement of said foot and leg members is prevented.

8. A removable stacking frame assembly and merchandise pallet as defined in claim 5 wherein said projection extending inwardly from one of said corner plates has an exterior longitudinal dimension less than the vertical height of said recess so that when seated vertical disengagement of said foot and leg member is prevented.

9. A removable stacking frame assembly adapted for use with a merchandise pallet wherein the pallet includes an upper platform surface and vertical sides extending downwardly from said upper platform surface, said pallet having a plurality of corners each formed by the intersection of two of said vertical sides, and said upper platform surface formed with a vertical opening adjacent each of said corners and at least one of said vertical sides adjacent said corner including a recess, said frame assembly comprising:

leg members equal in number to the number of corners of said pallet each of which is longitudinally rigid and resilient laterally of their own plane;

a foot member secured to the bottom of each of said leg members, said foot members each include a top plate and corner plates;

interior locking projections on said top plate and at least one of said corner plates;

each of said corner plates positioned to engage a portion of each vertical side where said sides intersect forming said corner and said locking projection on one of said corner plates seated in said recess, and said top plate adapted to be flexed upwardly whereby said locking projection extending therefrom clears said upper platform surface and said projection is oriented over said opening in said surface for release of said flexed top plate to engage said upper platform surface and to seat said locking projection in said opening and releasably maintain said foot member against vertical and lateral disengagement from said pallet; and an upper frame member connectable with the end of said legs remote said pallet whereby said upper frame member is spaced from and generally parallel to said upper platform surface of said pallet to complete said stacking frame.

* * * * *